US009114860B2

(12) United States Patent
Eckert et al.

(10) Patent No.: US 9,114,860 B2
(45) Date of Patent: Aug. 25, 2015

(54) KAYAK

(71) Applicant: Lifetime Products, Inc., Clearfield, UT (US)

(72) Inventors: Tom B. Eckert, Henderson, NV (US); Tim Niemier, Bellingham, WA (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 112 days.

(21) Appl. No.: 14/013,624

(22) Filed: Aug. 29, 2013

(65) Prior Publication Data

US 2014/0000500 A1 Jan. 2, 2014

Related U.S. Application Data

(63) Continuation of application No. 13/195,703, filed on Aug. 1, 2011, now Pat. No. 8,616,142.

(60) Provisional application No. 61/370,060, filed on Aug. 2, 2010.

(51) Int. Cl.

| | |
|---|---|
| ***B63B 35/71*** | (2006.01) |
| ***B63B 1/04*** | (2006.01) |
| *B63B 5/24* | (2006.01) |
| *B63B 43/04* | (2006.01) |
| *B63B 1/20* | (2006.01) |

(52) U.S. Cl.

CPC ..... *B63B 35/71* (2013.01); *B63B 1/042* (2013.01); *B63B 5/24* (2013.01); *B63B 43/04* (2013.01); *B63B 2001/201* (2013.01)

(58) Field of Classification Search

USPC ..... 114/347
IPC ..... B63B 35/71
See application file for complete search history.

(56) References Cited

U.S. PATENT DOCUMENTS

| | | | |
|---|---|---|---|
| 911,806 | A | 2/1909 | Broward |
| 2,079,871 | A | 5/1937 | Price |
| 2,126,106 | A | 8/1938 | Goildberg |
| 2,701,089 | A | 2/1955 | Fischer |
| 3,343,659 | A | 9/1967 | Marondel |
| 3,372,813 | A | 3/1968 | Ishida |
| 3,387,325 | A | 6/1968 | Sonneborn et al. |
| 3,860,305 | A | 1/1975 | Bergman |
| 3,863,829 | A | 2/1975 | Merrill |

(Continued)

FOREIGN PATENT DOCUMENTS

| | | |
|---|---|---|
| JP | 61-169883 | 10/1986 |
| WO | PCT/US14/40519 | 12/2014 |

OTHER PUBLICATIONS

International Preliminary Report on Patentability dated Mar. 25, 2014 from International Patent Application No. PCT/US2012/056630 filed Sep. 21, 2012.

(Continued)

*Primary Examiner* — Stephen Avila
(74) *Attorney, Agent, or Firm* — Workman Nydegger

(57) ABSTRACT

In one example, a watercraft is provided that includes a body having a bow and a stern whose respective shapes are substantially different from each other. The body includes a hull, an open cockpit, a ramp that is located aft of the open cockpit and slopes downwardly toward the stern, where a lower end of the ramp is located near the stern, and a transom, where the lower end of the ramp extends through the transom.

35 Claims, 3 Drawing Sheets

(56) References Cited

U.S. PATENT DOCUMENTS

| | | | |
|---|---|---|---|
| 4,066,032 | A | 1/1978 | Travis |
| 4,229,850 | A | 10/1980 | Arcouette |
| 4,483,380 | A | 11/1984 | Beran |
| 4,556,003 | A | 12/1985 | Prade |
| 4,589,365 | A | 5/1986 | Masters |
| 4,660,490 | A | 4/1987 | Broadhurst |
| 4,744,327 | A | 5/1988 | Masters |
| 4,802,708 | A | 2/1989 | Vos et al. |
| D308,662 | S | 6/1990 | Darby |
| 4,942,840 | A | 7/1990 | Masters et al. |
| 5,042,416 | A | 8/1991 | Arcouette |
| 5,061,215 | A | 10/1991 | Walls |
| 5,131,875 | A | 7/1992 | Lee |
| 5,356,201 | A | 10/1994 | Olson |
| D352,266 | S | 11/1994 | Niemier |
| D352,689 | S | 11/1994 | Niemier |
| 5,377,607 | A | 1/1995 | Ross |
| 5,397,525 | A | 3/1995 | Niemier |
| 5,405,002 | A | 4/1995 | Troia |
| 5,415,343 | A | 5/1995 | Vosbikian |
| 5,425,325 | A | 6/1995 | Washio |
| D364,139 | S | 11/1995 | Niemier |
| 5,493,982 | A | 2/1996 | Carpenter et al. |
| 5,573,115 | A | 11/1996 | Fuller |
| D377,473 | S | 1/1997 | Niemier |
| 5,662,505 | A | 9/1997 | Spriggs |
| D390,527 | S | 2/1998 | Niemier |
| D391,916 | S | 3/1998 | Masters |
| D394,630 | S | 5/1998 | Lincoln |
| 5,810,177 | A | 9/1998 | Cabiran |
| D400,843 | S | 11/1998 | Niemier |
| 5,842,566 | A | 12/1998 | White |
| 5,964,177 | A | 10/1999 | Niemier |
| 6,035,801 | A | 3/2000 | Addison |
| 6,112,692 | A | 9/2000 | Lekhtman |
| 6,132,267 | A | 10/2000 | Campbell |
| 6,152,063 | A | 11/2000 | Niemier |
| 6,178,912 | B1 | 1/2001 | Niemier |
| 6,210,242 | B1 | 4/2001 | Howard et al. |
| 6,289,838 | B2 | 9/2001 | Dust |
| 6,315,177 | B1 | 11/2001 | Weatherall |
| 6,325,014 | B1 | 12/2001 | Blanchard |
| 6,427,842 | B1 | 8/2002 | Green |
| 6,523,492 | B1 | 2/2003 | Neckar |
| 6,561,118 | B2 | 5/2003 | Mead |
| 6,669,516 | B1 | 12/2003 | Husted et al. |
| 6,681,968 | B2 | 1/2004 | Zwagerman |
| 6,718,905 | B1 | 4/2004 | Peerson et al. |
| 6,736,084 | B2 | 5/2004 | McDonough et al. |
| 6,739,276 | B1 | 5/2004 | Rard |
| 6,745,716 | B2 | 6/2004 | Belyeu |
| 6,755,145 | B2 | 6/2004 | Bolebruch |
| 6,837,378 | B2 | 1/2005 | Mason et al. |
| 6,863,014 | B2 | 3/2005 | Hudson et al. |
| 6,874,442 | B1 | 4/2005 | McDonough |
| 6,880,481 | B2 | 4/2005 | Dunn et al. |
| 6,923,137 | B2 | 8/2005 | Waits, Jr. |
| 6,964,243 | B1 | 11/2005 | Thompson |
| 6,990,920 | B2 | 1/2006 | Hamilton et al. |
| 7,021,234 | B1 | 4/2006 | Belyeu |
| 7,032,531 | B1 | 4/2006 | Caples |
| D544,824 | S | 6/2007 | Eckert |
| 7,320,291 | B2 | 1/2008 | Eckert |
| 7,370,596 | B2 | 5/2008 | Warren |
| 7,523,598 | B1 | 4/2009 | Eckert |
| 7,735,442 | B2 | 6/2010 | Richter |
| 7,887,381 | B2 | 2/2011 | Brass et al. |
| 7,987,654 | B1 | 8/2011 | Eckert |
| 2002/0109251 | A1 | 8/2002 | Sellepack |
| 2002/0166493 | A1 | 11/2002 | Sorensen |
| 2003/0003825 | A1 | 1/2003 | Keller |
| 2003/0106835 | A1 | 6/2003 | Hubbs et al. |
| 2004/0255828 | A1 | 12/2004 | Markling et al. |
| 2005/0241562 | A1 | 11/2005 | Nysether et al. |
| 2006/0060125 | A1 | 3/2006 | Pentecost |
| 2006/0254495 | A1 | 11/2006 | Eckert |
| 2007/0017431 | A1 | 1/2007 | Hopkins |
| 2008/0236471 | A1 | 10/2008 | Mott |
| 2009/0038526 | A1 | 2/2009 | Walton |
| 2009/0064917 | A1 | 3/2009 | Mackereth |
| 2010/0009579 | A1 | 1/2010 | Wood |
| 2012/0017821 | A1 | 1/2012 | McDonough |
| 2013/0074760 | A1 | 3/2013 | Van Nimwegen et al. |
| 2013/0340669 | A1 | 12/2013 | VanNimwegen et al. |

OTHER PUBLICATIONS

Office Action dated Mar. 26, 2014 from U.S. Appl. No. 14/011,609, filed Aug. 27, 2013.
Notice of Allowance dated Apr. 1, 2014 from U.S. Appl. No. 13/623,691, filed Sep. 20, 2012.
EMSCO Group, Voyager Family Recreation Kayak Marketing Brochure, Aug. 9, 2004 (2 pages).
Dragonfly Innovations,Moorea Marketing Brochure, Aug. 9, 2005 (1 page).
Emotion Kayaks—Fishing Kayaks, www.emotionkayaks.com/fishing-kayaks/, Jun. 18, 2012 (1 page).
Emotion Kayaks—Sit-On-Top Kayaks, www.emotionkayaks.com/sit-on-top/, Jun. 18, 2012 (1 page).
Emotion Kayaks—Parts, www.emotionkayaks.com/gear/parts.php, Jun. 18, 2012 (3 pages).
Emotion Kayaks—Sit Inside Kayaks, www.emotionkayaks.com/sit-inside/, Jun. 18, 2012.
International Search Report and Written Opinion dated Jan. 2, 2013 from International Patent Application No. PCT/US2012/056630 filed Sep. 21, 2012.
Notice of Allowance dated Jan. 15, 2009 from U.S. Appl. No. 11/688,361, filed Mar. 20, 2007.
Office Action dated Apr. 18, 2008 from U.S. Appl. No. 11/688,361, filed Mar. 20, 2007.
Notice of Allowance dated Feb. 1, 2011 from U.S. Appl. No. 12/431,613, filed Apr. 28, 2009.
Office Action dated Jul. 16, 2010 from U.S. Appl. No. 12/431,613, filed Apr. 28, 2009.
Office Action dated Mar. 18, 2008 from U.S. Appl. No. 11/591,184, filed Oct. 31, 2006.
Office Action dated Apr. 5, 2006 from U.S. Appl. No. 11/186,737, filed Jul. 21, 2005.
Office Action dated Apr. 4, 2011 from U.S. Appl. No. 12/538,645, filed Aug. 10, 2009.
Office Action dated May 26, 2011 from U.S. Appl. No. 12/538,822, filed Aug. 10, 2009.
Office Action dated Apr. 27, 2011 from U.S. Appl. No. 29/322,698, filed Aug. 8, 2008.
Office Action dated Aug. 20, 2010 from U.S. Appl. No. 29/322,698, filed Aug. 8, 2008.
Office Action dated Jul. 5, 2013 from U.S. Appl. No. 13/623,691, filed Sep. 20, 2012.
Office Action dated Jun. 6, 2013 from U.S. Appl. No. 13/195,703, filed Aug. 1, 2011.
Office Action dated Mar. 20, 2013 from U.S. Appl. No. 13/195,703, filed Aug. 1, 2011.
Notice of Allowance dated Aug. 23, 2013 from U.S. Appl. No. 13/195,703, filed Aug. 1, 2011.
Notice of Allowance dated Aug. 24, 2006 from U.S. Appl. No. 29/234,705, filed Jul. 21, 2005.
U.S. Appl. No. 11/186,737, filed Jul. 21, 2005.
U.S. Appl. No. 29/234,705, filed Jul. 21, 2005.
U.S. Appl. No. 29/322,698, filed Aug. 8, 2008.
U.S. Appl. No. 12/538,822, filed Aug. 10, 2009.
U.S. Appl. No. 12/538,645, filed Aug. 10, 2002.
U.S. Appl. No. 11/591,184, filed Oct. 31, 2006.
U.S. Appl. No. 13/195,703, filed Aug. 1, 2011.
U.S. Appl. No. 13/623,691, filed Sep. 20, 2012.

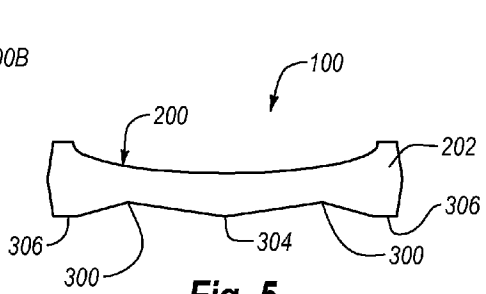
Fig. 5
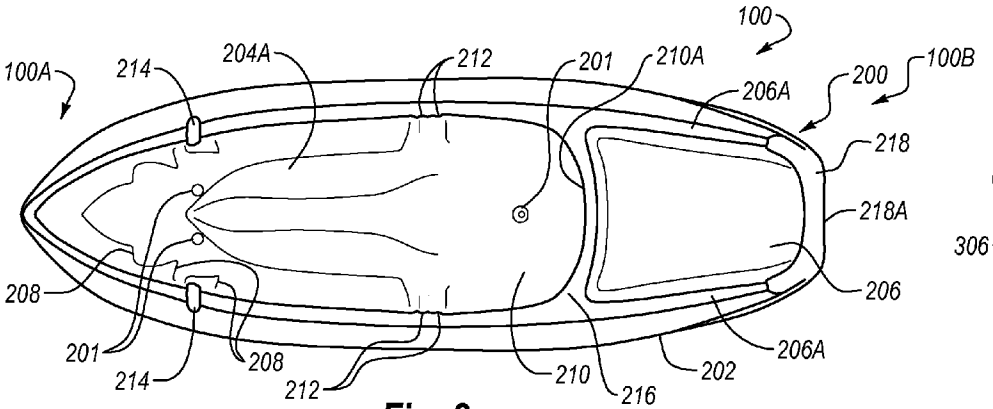
Fig. 2
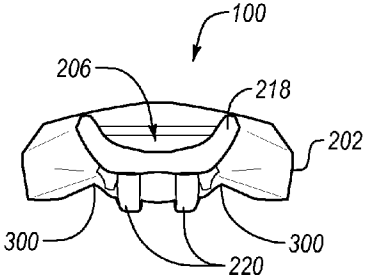
Fig. 4
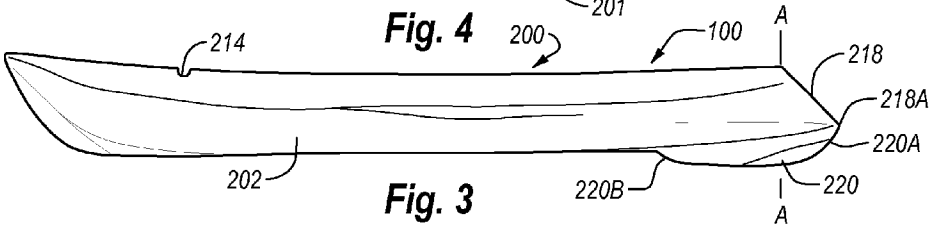
Fig. 6
Fig. 3

KAYAK

RELATED APPLICATIONS

This application is a continuation of U.S. patent application, Ser. No. 13/195,703, entitled KAYAK, and filed on Aug. 1, 2011, which, in turn, claims priority to U.S. Provisional Patent Application, Ser. No. 61/370,060, entitled KAYAK, filed Aug. 2, 2010. All of the aforementioned applications are incorporated herein in their respective entireties by this reference.

FIELD OF THE INVENTION

At least some example embodiments of the invention concern kayaks. However, one or more of the concepts, in various combinations, disclosed herein may extend to other types of watercraft as well such as, for example, sailboats, surfboards, paipo boards, boards for wind surfers, paddleboards, knee boards, canoes, wakeboards, and body boards, examples of which include boards referred to as boogie boards.

DESCRIPTION OF RELATED ART

Kayaks can be difficult to stabilize and maneuver, especially for children. It can also be difficult for children to enter or reenter a kayak especially, for example, after they fall off of the kayak. In addition, it can be difficult for children to initially sit on a kayak or get back on the kayak if they fall off. One or more of these problems may manifest themselves in other types of watercraft as well.

ASPECTS OF AN EXAMPLE EMBODIMENT OF THE INVENTION

Disclosed embodiments are concerned with watercraft. Some example embodiments within the scope of this disclosure may, but need not, include one or more of the following elements, in any combination: a sloped transom; a ramp; one or more projections on the bottom of the hull; one or more longitudinal recesses on the bottom of the hull; a cockpit; a reverse-chine geometry incorporated in the hull. None of the foregoing should be interpreted to be an essential or critical element, and other embodiments may omit one or more of any of the foregoing elements while remaining within the scope of the invention. Moreover, none of the aforementioned elements are mutually exclusive and all could be included in a single embodiment.

In one example embodiment, a kayak is provided that includes one, some or all of the aforementioned elements, in any combination. A portion, or all, of the kayak may be constructed of blow-molded plastic and one or more of the aforementioned elements, in any combination, may be integrally formed as part of the kayak during a blow-molding process.

BRIEF DESCRIPTION OF THE DRAWINGS

The appended drawings contain figures of example embodiments to further illustrate and clarify various aspects of the present invention. It will be appreciated that these drawings depict only example embodiments of the invention and are not intended to limit its scope. Aspects of the invention will be described and explained with additional specificity and detail through the use of the accompanying drawings in which:

FIG. 2 is a top view of the kayak shown in FIG. 1;

FIG. 3 is a side view of the kayak shown in FIG. 1;

FIG. 4 is a bottom view of the kayak shown in FIG. 1;

FIG. 5 is a cross-sectional view of a portion of the kayak shown in FIG. 1;

FIG. 6 is a rear view of the kayak shown in FIG. 1; and

DETAILED DESCRIPTION OF SOME EXAMPLE EMBODIMENTS

Figure 1:
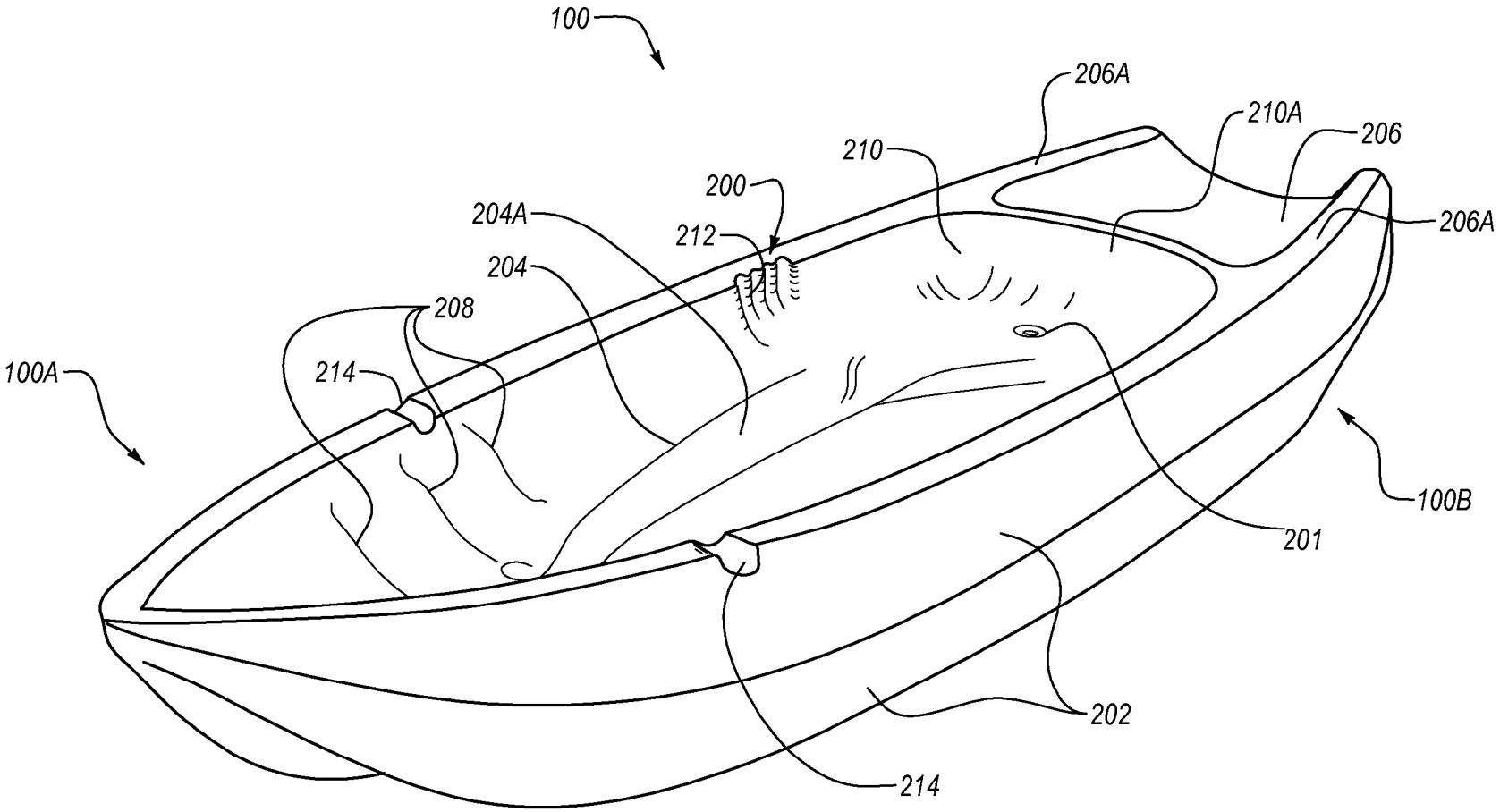
FIG. 1 is a perspective view of an example of a kayak.

As noted elsewhere herein, at least some example embodiments of the invention concern kayaks. However, one or more of the concepts, in any combination, disclosed herein may extend to other types of watercraft as well such as, for example, sailboats, surfboards, paipo boards, boards for wind surfers, paddleboards, knee boards, canoes, wakeboards, and body boards, examples of which include boards referred to as boogie boards. Thus, the scope of this disclosure is not limited to kayaks, or to any other type(s) of watercraft.

A. General Aspects of Some Example Embodiments

While the discussion herein makes reference to a kayak, it should be understood that reference to a kayak is by way of illustration and the discussion applies as well to the various other types of watercraft disclosed herein, and to any other types of watercraft that would be apparent to a person of ordinary skill in the art.

In at least some embodiments, a portion, or all, of a watercraft such as a kayak may be constructed of blow-molded plastic. However, the scope of this disclosure is not limited to blow-molding processes or blow-molded elements. Other processes that may be used to construct a portion, or all, of a kayak, or other watercraft, include roto-molding, vacuum molding, and processes sometimes referred to as twin-sheet processes. It will also be appreciated that the kayak need not be constructed from plastic and may be constructed using other materials having other suitable characteristics.

Portions of a kayak that may be integrally formed as part of the kayak by way of a blow-molding process include, in any combination, one or more of: a sloped transom; a ramp; one or more projections on the bottom of the hull; one or more longitudinal recesses on the bottom of the hull; a cockpit; a reverse-chine geometry incorporated in the hull. Additionally, or alternatively, one or more other elements, in any combination, may be integrally formed with the kayak as part of a blow-molding process. Examples of such other elements include, but are not limited to, seats, hand holds, foot wells, recesses of any type, storage areas, drain holes, paddle rests, and projections of any type.

In at least some instances, one or more of the elements disclosed herein, such as the preceding examples, may be integrally formed with a hull of the kayak as part of a blow-molding, or other, process. Any embodiment of the kayak that is constructed at least partly of blow-molded plastic may have an interior that is partly, or completely, hollow. Such embodiments may also include, disposed in the interior, one or more depressions, sometimes referred to as "tack-offs." In such embodiments, these tack-offs may be integrally formed as part of a unitary, one-piece structure during the blow-molding process. The depressions may extend from a first surface, such as a first interior surface of the kayak, towards a second surface, such as a second interior surface of the kayak. The ends of one or more depressions may contact or engage the second surface, or the ends of one or more of the depressions may be spaced apart from the second surface by a distance.

In some instances, one or more depressions on a first interior surface may be substantially aligned with corresponding depressions on a second interior surface, and one or more depressions on the first interior surface may contact one or more corresponding depressions on the second interior surface or, alternatively, one or more depressions on the first interior surface may be spaced apart from corresponding depressions on the second interior surface. In still other instances, depressions that contact each other, and depressions that are spaced apart from each other, may both be present in a kayak. The depressions may be sized and configured to strengthen and/or reinforce the blow-molded plastic hull and/or other portions of the kayak.

Any of the embodiments disclosed herein, or derived from this disclosure, may also include a surface treatment, examples of which include ethylene-vinyl acetate (EVA) foam decking, ABS sheeting and polyethylene sheeting, disposed on at least a portion of the kayak, such as the transom and/or ramp for example. Other surface treatments, such as texturing for example, may be formed as part of a blow-molding process. In one example of a surface treatment that may be included in any embodiment, the surface treatment may be configured to provide a grippable surface for a user so that the user can more readily grasp, and keep hold of, a portion of the kayak, such as the transom and/or ramp for example. In another example that may be included in any embodiment, the hull and/or other portions of the kayak has one or more surfaces, such as on the transom and/or ramp for example, with a chemically etched textured portion that provides traction and may allow for elastomeric sheathing to be adhered. In still further examples, one or more surfaces of the kayak are textured, and the sheathing or other covering may be omitted.

At least some embodiments of the kayak are particularly well-suited by use for children, as well as adults of relatively small stature. In one particular example, a kayak of about 70 to about 90 inches in length may be well-suited for use by such individuals, although other lengths may be employed as well. In a further example, a kayak of about 80 inches in length may be used. A kayak of approximately 80 inches in length may, for example, have a width that is about 20 to 30 inches, such as about 26 inches. It should be understood that the length-to-width ratio implicit in the foregoing example dimensions may be extended to define lengths and widths of other kayak embodiments.

B. Description of Some Example Embodiments

Turning now to FIGS. 1-7, details are provided concerning some example embodiments of a watercraft. With regard first to FIGS. 1 and 2, a watercraft is indicated that, in this example, takes the form of a kayak 100, although the scope of the invention is not limited to kayaks. The kayak 100 has a front 100*a* and a back 100*b*, and includes a body 200 that, as noted elsewhere herein, may have a unitary single-piece construction formed by a blow-molding, or other, process. The body 200, including the hull 202, may include one or more tack-offs 201. The body 200 may include, among other things, a hull 202, a cockpit 204, and a ramp 206. In some instances, the cockpit 204 may have a size and configuration ergonomically suited to individuals such as children, and/or relatively small adults.

In some cases, the cockpit 204 may extend over approximately the forward two-thirds of the overall length of the kayak 100, although other embodiments may employ a cockpit 204 that is longer, or shorter, than two-thirds of the overall length of the kayak 100. More particularly, aspects such as the width, depth and length of the cockpit 204 may be configured to suit individuals of particular physical size(s). In some instances, and as indicated in FIG. 1 for example, the forward portion of the cockpit 204 may be relatively deeper than the rear portion of the cockpit 204.

With continued reference to FIGS. 1 and 2, the cockpit 204 may include a generally centrally located, upwardly extending projection 204*a* that may be longitudinally disposed along at least a substantial portion of the length of the cockpit 204. The projection 204*a* may be designed to be ergonomically uncomfortable for the legs of a user unless the user maintains the correct leg positions for kayak paddling. For example, the projection 204*a* may be designed to guide the legs of a user into a spaced-apart position, which may help increase the balance and motor skills of the user when the user is paddling. This may be particularly advantageous when training new and/or younger users, such as children. Finally, the projection 204*a* may comprise, or be implemented as, a tack-off.

In addition to the overall configuration of the cockpit 204, the body 200 may include various other elements that may enhance the usefulness and functionality of the kayak 100. By way of example, the body 200 may include one or more foot wells 208 on either side of the cockpit 204. Aspects such as the size, geometry, orientation, number, location and spacing of the foot wells 208 can be selected as desired. Among other things, the foot wells 208 may enable a user to position his or her feet in a variety of different locations within the cockpit 204. This flexibility in positioning may prove useful where considerations such as physical size and paddling style can vary from one user to another. As well, different water, wind and other environmental conditions may dictate changes in the foot position of a user.

The body 200 may also include a seating area 210 configured to accommodate a user. The seating area 210 may form a portion of the cockpit 204 and be recessed in such a way as to provide a back portion 210*a* that can support the user, and against which the user can push. In at least some embodiments, the body 200 may include one or more hand holds 212 on either side of the cockpit 204. In general, the hand holds 212 are sized and configured to enable a user to grasp and hold the kayak 100. The size, number, location, and spacing of the hand holds 212 may be selected as desired.

In some implementations, the body 200 may include one or more paddle rests 214. In the example of FIGS. 1 and 2, two paddle rests 214 are provided, one on each side of the kayak 100. The paddle rests 214 may take the form of recesses into which the handle of a paddle (not shown) can be set. In some instances, the paddle rests 214 may be configured to enable the handle of the paddle to be snap fit into the paddle rests 214 so as to help ensure that the paddle does not come adrift until the user is ready to use it. The paddle rests 214 may have an approximately circular partial cross-section so as to generally complement the cross-sectional shape of the handle of the paddle, although any other cross-sectional shape may be employed for the paddle rests 214.

With continued reference to FIGS. 1 and 2, further details are provided concerning the ramp 206. As indicated in FIG. 2, the ramp 206 may be separated from the cockpit 204 by a partition 216, although separation of the ramp 206 from the cockpit 204 is not necessary and is not implemented in all embodiments. In some embodiments, the ramp 206 extends over approximately the rear one-third of the overall length of the kayak 100, although other embodiments may employ a ramp that is longer, or shorter, than one-third of the overall length of the kayak 100. As indicated in FIGS. 1 and 2, the ramp 206 may be recessed within the body 200, although in other embodiments, a ramp may be formed on top of the body. As best shown in FIG. 1, the ramp 206 slopes downwardly from the partition 216 toward the back of the kayak 100, and the ramp 206 may be relatively wider at one end than at the other end.

The ramp 206 may be sloped at any desired angle and some or all of the ramp 206 may, or may not, include surface treatments and/or surface coverings that provide a grippable surface which may better enable a user to grip and/or mount the kayak 100. Moreover, side rails 206*a* which may, in some implementations, form a portion of the hull 202, may also include surface treatments and/or surface coverings that provide a grippable surface which may better enable a user to grip and/or mount the kayak 100.

Among other things, the ramp 206 may enhance the usability and functionality of at least some embodiments of the kayak 100. For example, if a user falls from the kayak 100, it may be possible for the user to more easily reenter the kayak 100 using the ramp 206. Even if the user lacks sufficient upper-body strength to reenter the kayak 100 in this manner (e.g., if the user is a child), the ramp 206 may allow the user to mount a portion of the kayak 100 and use the kayak 100 as a floatation device until help comes or use the kayak 100 as a kickboard to return to shallow water.

With continued reference to FIG. 2, and directing attention now to FIG. 3 as well, at least some embodiments of a watercraft such as the kayak 100 include a transom 218 which, in at least some embodiments, may comprise a portion of the hull 202. As best shown in FIG. 2, where an embodiment includes both a transom 218 and a ramp 206, the transom 218 may intersect the ramp 206. The transom 218 may slope rearwardly and downwardly at any desired angle. An angle that is within the range of about 40 degrees to about 50 degrees may be particularly useful in some instances. In some cases, a transom 218 angle of about 45 degrees may be employed. It should be noted that the angle of the transom 218 in these examples may be measured relative to a substantially vertical reference line AA (FIG. 3).

Figure 7:
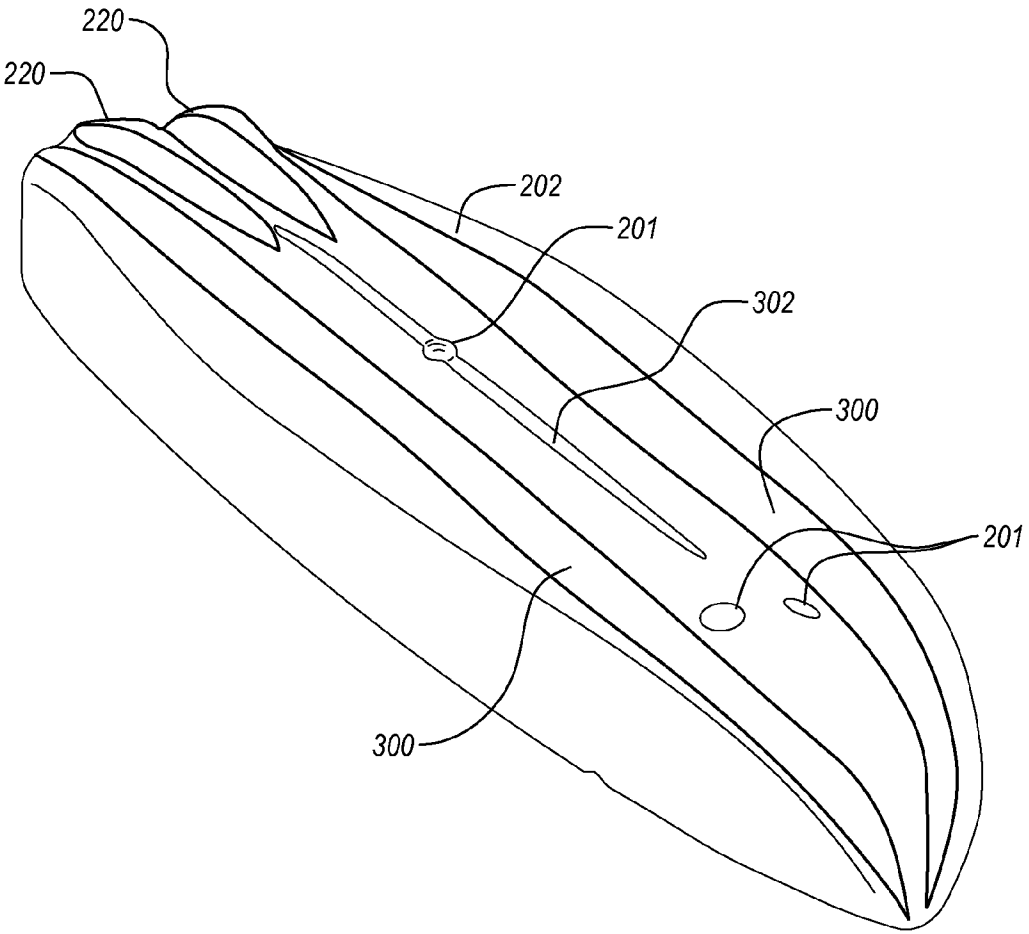
FIG. 7 is a perspective view of the bottom of the kayak shown in FIG. 1.

Directing attention now to FIGS. 4-7, and with continuing attention to FIG. 3, details are provided concerning additional elements, one or more of which may be included, in any combination, in at least some embodiments of the invention. As indicated in FIGS. 3, 4, 6 and 7, at least some embodiments may include one, two, or more projections 220 extending downwardly from the hull 202. The projections 220 may be substantially mirror images of each other, although that is not required. As best indicated in FIGS. 4 and 7, the projections 220 may be generally wedge-shaped, or at least the projections 220 may be wider at one end than at the other. Where a projection 220 is generally wedge-shaped, a desired wedge angle θ may be employed (FIG. 4). In at least some embodiments, a wedge angle of less than about 45 degrees may be used.

In the illustrated example, the relatively wider portion of each projection 220 is located closer to the back 100*b* of the kayak 100 than is the relatively narrow portion of each projection 220. The length of the projections 220 may be about one-quarter to about one-sixth of the overall length of the kayak 100, although other dimensional relationships may alternatively be implemented. Likewise, the width and height (i.e., the extent to which the projections 220 extend below the hull 202) may be varied as desired. With particular regard to the height of the projections 220, the example of FIG. 3 indicates that the projections 220 may have a height that varies over the length of the projection 220, with the portion of relatively greater height being located near the back 100*b* of the kayak.

As best indicated in FIGS. 3 and 6, the rearmost portion 220*a* of the projections 220 may curve or otherwise extend upwards so as to meet the edge 218*a* defined by the transom 218. As well, and indicated in FIGS. 3 and 7, the forward most portion 220*b* of the projections 220 may curve or otherwise extend upwards so as to meet a portion of the hull 202. Alternatively, the projections 220 may extend beyond edge 218*a*, or terminate short of edge 218*a*. Moreover, one or more of the sides 220*c* of the projections 220 may be sloped, or may be substantially vertical.

With regard to their positioning, the projections 220 may each be disposed on a respective side of a centerline CL of the kayak 100 (FIG. 4), although other locations are possible as well. Where multiple projections 220 are employed, two or more of the projections 220 may be substantially parallel with each other and/or with the centerline, although this is not required. As well, two projections 220 may be arranged on opposite sides of the centerline in such a way as to be at least approximately the same distance away from the centerline CL.

In some instances, one or more additional projections (not shown) are provided that are relatively larger, or smaller, in one or more of their length, width, and height, than the projections 220. Such additional projections may be located near the rear of the kayak 100, or anywhere else on the kayak 100. Finally, one or more of the projections 220 may comprise, or be implemented as, a tack-off More generally, the scope of the invention is not limited to any particular, number, size, geometry, location, or orientation of projections. Rather, any one or more of these aspects may be varied to define yet further embodiments.

The use of one or more projections, such as the example projections 220, in embodiments of the kayak may provide various benefits. By way of example, the projections may serve to contribute to a relative increase in the buoyancy of the kayak, as compared to the buoyancy that would be associated with the kayak if the projections were not present. This added buoyancy may help prevent the front of the kayak from pitching upward significantly when a user mounts or reenters the kayak using the transom and/or the ramp. As well, the wedge shape of some examples of the projections may serve to guide the kayak in the tracking, or forward straight line, direction.

With reference now to FIGS. 4-7, details are provided concerning further elements that may be included in at least some embodiments of the kayak. Particularly, at least some embodiments may include one or more longitudinal recesses 300 located on the bottom of the kayak 100. The longitudinal recesses 300 may, but need not, be substantially identical to each other. The longitudinal recesses 300 may extend generally along a portion of the length of the kayak 100 and may be at least approximately parallel to the centerline CL. In at least some embodiments, the longitudinal recesses 300 extend along a substantial portion of the length of the kayak 100. In the particular example of FIG. 4, two longitudinal recesses 300 are provided, with a longitudinal recess 300 positioned on either side of the centerline CL. The longitudinal recesses 300 may or may not be generally equidistant from the centerline CL. In that same example, the longitudinal recesses 300 are arranged such that one or more projections 200 are positioned between the longitudinal recesses 300.

The longitudinal recesses 300 may be relatively wide. For example, in at least some embodiments, one or more longitudinal recesses 300 may have a maximum width in a range of about 15 percent of the overall width of the kayak 100 to about 25 percent of the overall width of the kayak 100. In one particular embodiment, one or more longitudinal recesses 300 may have a maximum width of about 20 percent of the overall width of the kayak 100. Larger, or smaller, recess widths may be employed in other embodiments. As indicated, for example, in FIG. 4, the width of a longitudinal recess 300 may vary over the length of the longitudinal recess 300. In a more particular example, a longitudinal recess 300 may be relatively wider in a middle portion 300*a* of the longitudinal recess 300 than in one or both end portions 300*b* and 300*c* of the longitudinal recess 300.

Additionally, or alternatively, the longitudinal recesses 300 may be relatively deep. For example, in at least some embodiments, one or more longitudinal recesses 300 may have a maximum depth in a range of about 10 percent of the overall depth of the kayak 100 to about 20 percent of the overall depth of the kayak 100, where the depth is measured from the bottom of the hull 202 to the uppermost portion of the front 100*a* of the kayak 100. In one particular embodiment, one or more longitudinal recesses 300 may have a depth of about 15 percent of the overall depth of the kayak 100. Larger, or smaller, recess depths may be employed in other embodiments.

The geometry of one or more longitudinal recesses may be such that a longitudinal recess has a substantially triangular cross-section, as indicated in FIG. 6 and discussed below. One consequence of this example construction is that the width of a longitudinal recess may vary with the depth of the longitudinal recess. Alternatively, one or more longitudinal recesses may have a generally parabolic, circular, or other curved cross-section shape. Finally, one or more of the longitudinal recesses 300 may comprise, or be implemented as, a tack-off Finally, a further recess 302 may be provided that extends along a portion of the length of the kayak 100. In at least some instances, the recess 302 may be at least approximately parallel to, and located near or on, the centerline CL. The recess 302 may comprise, or be implemented as, a tack-off, such as tack-off 201 for example (see Figure 4). Among other things, this recess 302 may serve to enhance the stability and/or maneuverability of the kayak 100.

More generally, the scope of the invention is not limited to any particular, number, size, geometry, location, or orientation of longitudinal recesses. Rather, any one or more of these aspects may be varied to define yet further embodiments.

With particular reference now to FIGS. 5 and 6, further details are provided concerning aspects of an example hull configuration of a kayak 100. As indicated in those Figures, and discussed above, at least some embodiments include a pair of longitudinal recesses 300 that cooperate to at least partly define a reverse-chine geometry in the hull 202. The reverse-chine geometry may include a projection 304 cooperatively defined by the longitudinal recesses 300. In other embodiments, no projection 304 is present and a transition portion, which may be flat or curved, is disposed between the two longitudinal recesses 300. As further indicated in FIG. 5 in particular, each of the longitudinal recesses 300 may abut a relatively flat portion 306. In some instances, the portions 306 may be angled upward. This angled construction may help the kayak 100 to avoid catching a wave during a turn.

The reverse-chine geometry indicated in FIGS. 5 and 6 may prove beneficial in some circumstances. For example, longitudinal recesses 300 may extend generally upwardly and may help water to be pressurized under the kayak 100 when, for example, the kayak 100 is rocked back and forth. This pressurization may help create horizontal stability that helps resist tipping of the kayak 100 and/or flipping over of the kayak 100.

With particular reference, finally, to FIGS. 1 and 7, the bow construction at the front 100*a* of the kayak 100, which may be referred to as a 'cathedral' structure may be useful in reducing or minimizing splashing as the kayak 100 moves through the water.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A watercraft, comprising:

a body that includes a bow and a stern whose respective shapes are substantially different from each other, the body including:

a hull;

an open cockpit;

a ramp that is located aft of the open cockpit and slopes downwardly toward the stern, where a lower end of the ramp is located proximate the stern; and a transom that forms a portion of the stern and extends across a width of the watercraft, the transom defining an opening proximate the lower end of the ramp.

2. The watercraft as recited in claim 1, wherein a portion of the watercraft has a unitary single-piece construction.

3. The watercraft as recited in claim 1, wherein the body comprises plastic and includes one or more tack-offs.

4. The watercraft as recited in claim 1, wherein one or more of the cockpit, ramp, and transom are integral with the hull.

5. The watercraft as recited in claim 1, wherein the stern has a squared off shape, and the bow has a pointed shape.

6. The watercraft as recited in claim 1, wherein the ramp is recessed in the body.

7. The watercraft as recited in claim 1, wherein a portion of the ramp has a generally concave cross-sectional shape.

8. The watercraft as recited in claim 1, wherein the watercraft comprises a kayak.

9. A kayak, comprising:

a body with a generally pointed bow and a squared off stern, the body including:

a hull;

an open cockpit;

a ramp that is located aft of the open cockpit and has first and second opposing sides, wherein a lower end of the ramp is located proximate the stern; and a transom that defines an opening proximate the lower end of the ramp, the opening extending across the kayak between the first and second sides of the ramp.

10. The kayak as recited in claim 9, wherein the body has a unitary single-piece construction comprising plastic and one or more tack offs.

11. The kayak as recited in claim 9, wherein a portion of the hull includes a reverse chine configuration.

12. The kayak as recited in claim 9, wherein a bottom of the hull includes two longitudinal recesses that extend a substantial portion of a length of the hull.

13. The kayak as recited in claim 9, further comprising two wedge-shaped projections extending downwardly from the hull and located proximate the stern, each projection disposed on a respective side of a centerline of the hull, and each projection being substantially parallel with the centerline.

14. The kayak as recited in claim 9, wherein the kayak has only a single seating surface, the single seating surface located immediately forward of the ramp.

15. A kayak, comprising:

a body that includes a bow and a stern whose respective shapes are substantially different from each other, the body including:

a hull that includes a reverse chine configuration;

two wedge-shaped projections extending downwardly from the hull and located proximate the stern, each projection disposed on a respective side of a centerline of the hull, and each projection being substantially parallel with the centerline;

an open cockpit;

a ramp that is located aft of the open cockpit and slopes downwardly toward the stern, where a lower end of the ramp is located proximate the stern; and a transom angled toward the bow, wherein the lower end of the ramp defines an opening in the transom.

16. The kayak as recited in claim 15, wherein the body has a unitary single-piece construction comprising plastic and one or more tack offs.

17. The kayak as recited in claim 15, wherein the kayak has only a single seating surface, the single seating surface located immediately forward of the ramp.

18. The kayak as recited in claim 15, wherein the ramp is recessed in the body.

19. The kayak as recited in claim 15, wherein the reverse chine configuration comprises a pair of reverse chines, and the kayak further comprises a chine disposed between the reverse chines.

20. The kayak as recited in claim 15, wherein a length of the ramp is about one third of an overall length of the kayak, and a length of the open cockpit is about two thirds of the overall length of the kayak.

21. A kayak, comprising:

a body that includes a bow and a stern whose respective shapes are substantially different from each other, the body including:

a hull;

a cockpit connected with the hull and including a seating area;

a ramp located behind the cockpit and extending to a location proximate the stern, the ramp including an open area that extends across a majority of a width of the kayak, and the open area is bounded in part by first and second side rails at respective sides of the kayak; and a transom that defines an opening proximate a terminal end of the ramp.

22. The kayak as recited in claim 21, wherein a portion of the kayak has a unitary single-piece construction and includes one or more tack offs.

23. The kayak as recited in claim 21, wherein the kayak has a sit-on-top configuration.

24. The kayak as recited in claim 21, further comprising a reverse chine geometry incorporated in a bottom of the hull and including first and second reverse chines that extend along a substantial portion of a length of the hull and terminate proximate the stern, wherein the first and second reverse chines are defined in part by respective first and second longitudinal recesses defined in the bottom of the hull.

25. The kayak as recited in claim 21, further comprising any of a foot well, a paddle rest, a handhold, a recessed area located aft of the seating area and extending to the stern, or any combination of the foregoing.

26. The watercraft as recited in claim 1, wherein the transom is substantially flat.

27. The watercraft as recited in claim 1, wherein the transom lies in an inclined plane.

28. The watercraft as recited in claim 1, wherein a portion of the transom is curved.

29. The watercraft as recited in claim 1, wherein a portion of the transom is straight.

30. The watercraft as recited in claim 1, wherein the opening is generally U-shaped.

31. The watercraft as recited in claim 1, wherein the transom is the aft-most portion of the watercraft.

32. The kayak as recited in claim 9, wherein the opening is generally U-shaped.

33. The kayak as recited in claim 9, wherein the opening enables water from the ramp to drain out of the kayak through the transom.

34. The kayak as recited in claim 9, wherein the ramp further comprises first and second side rails disposed on respective sides of the kayak.

35. The kayak as recited in claim 9, wherein the ramp is configured to direct water through the transom.

* * * * *

UNITED STATES PATENT AND TRADEMARK OFFICE

CERTIFICATE OF CORRECTION

PATENT NO. : 9,114,860 B2
APPLICATION NO. : 14/013624
DATED : August 25, 2015
INVENTOR(S) : Eckert et al.

It is certified that error appears in the above-identified patent and that said Letters Patent is hereby corrected as shown below:

In the specification,

Column 5
Line 9, change "may also" to --and may also--

Column 6
Line 57, change "projections 200" to --projections 220--

Signed and Sealed this
Tenth Day of May, 2016

Michelle K. Lee

Michelle K. Lee
*Director of the United States Patent and Trademark Office*